United States Patent [19]

Kusz

[11] Patent Number: 4,971,212

[45] Date of Patent: Nov. 20, 1990

[54] TAMPER INDICATING PACKAGES

[75] Inventor: Maximillian Kusz, Waterville, Ohio

[73] Assignee: Owens-Illinois Closure Inc., Toledo, Ohio

[21] Appl. No.: 418,298

[22] Filed: Oct. 6, 1989

[51] Int. Cl.[5] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,394,918 | 7/1983 | Grussen | 215/252 X |
| 4,488,655 | 12/1984 | Itsubo et al. | 215/252 |
| 4,520,939 | 6/1985 | Itsubo et al. | 215/252 |
| 4,550,844 | 11/1985 | Lininger | 215/252 |
| 4,653,657 | 3/1987 | Papavasilopoulos | 215/252 |
| 4,807,771 | 2/1989 | Roy et al. | 215/252 |

*Primary Examiner*—Donald F. Norton

[57] ABSTRACT

A tamper indicating package comprising a container having a finish with external threads thereon and a plastic closure comprising a base wall and a peripheral skirt. The closure has a tamper indicating band connected to the skirt along a weakened line and has at least one flange extending upwardly and inwardly for engagement with a retaining bead on the container. The flange is hinged to the band along a first hinge at one end extending circumferentially of the band and along a second hinge at an angle to the first hinge. The other end of the flange circumferentially spaced with respect to the second hinge is free such that when the closure is applied to the container the flange flexes over the retaining bead on the container until the free edge of the flange extends beneath the retaining bead on the container and when the closure is rotated to remove the closure, the flange prevents the band from being removed and causes severing of the band along the weakened line.

10 Claims, 3 Drawing Sheets

TAMPER INDICATING PACKAGES

BACKGROUND AND SUMMARY OF THE INVENTION

In packaging containers having closures thereon, it has been common to provide tamper indicating packages wherein the tamper indicating band is connected to the closure along the weakened line provided by a plurality of bridges or a scoreline and interengaging means between the band and the container are such that when the closure is unthreaded from the container, the band is severed along the weakened line to indicate that the closure has been tampered with.

In U.S. Pat. No. 4,394,918 issued to Jean Grussen on July 26, 1983, a threaded closure carries a hold ring that is joined to the bottom of the cap skirt by a series of breakable tabs and the hold ring has an inside diameter that is at least equal to the outside diameter of the cap skirt. A plurality of lock lugs supported on the ring are inclined upwardly and inwardly and are intended to hook behind a collar or mating ring on the container neck to prevent the hold ring from being lifted off the container neck when the cap is unscrewed.

In U.S. Pat. No. 4,550,844, having a common assignee with the present application, there is disclosed and claimed an arrangement wherein a continuous annular flange extends from the lower end of the tamper indicating band and is inclined upwardly and inwardly. Such an arrangement is effective but has the disadvantage in that continuous flange requires excessive force to apply the closure to the container in certain extreme tolerance conditions.

In an effort to reduce the force required to apply the closure, it has heretofore been suggested in U.S. Pat. No. 4,653,657 that the free edge of the continuous annular flange be provided with a plurality of segments to facilitate application of the closure.

U.S. Pat. No. 4,807,771 proposes the use of a plurality of spaced-apart ring segments on the tamper indicating band to define independently foldable ring segments and a plurality of resilient tabs connected to each end of each ring segment so that the free ends of the tabs bear on the bead or ledge of the container.

Accordingly, among the objectives of the present invention are to provide a tamper indicating package with an improved arrangement for interengaging the closure with the container so that when the closure is removed the tamper indicating band remains on the container; wherein the closure can be readily applied to the container; wherein the tamper indicating package effectively minimizes tampering; wherein there is no need for inverting of any portion of the closure after molding; wherein the closure can be designed to provide different degrees of retention; and which can be readily manufactured.

In accordance with the invention, the tamper indicating package comprises a container having a finish with external threads thereon and a plastic closure comprising a base wall and a peripheral skirt. The closure has a tamper indicating band connected to the skirt along a weakened line. The band has at least one flange extending upwardly and inwardly for engagement with retaining means on the container. The flange is hinged to the band along a first hinge extending circumferentially of the band and along a second hinge at an angle to the first hinge at one end. The other end of the flange circumferentially is spaced with respect to the second hinge free such that when the closure is applied to the container the flange flexes over the retaining means on the container until the free edge of the flange extends beneath the retaining means on the container and when the closure is rotated to remove the closure, the flange prevents the band from being removed and causes severing of the band along the weakened line.

DESCRIPTION

Figure 1:
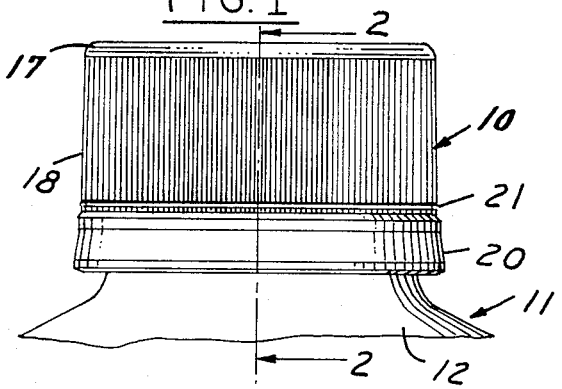
FIG. 1 is a fragmentary elevational view of a tamper indicating package embodying the invention.
Figure 2:
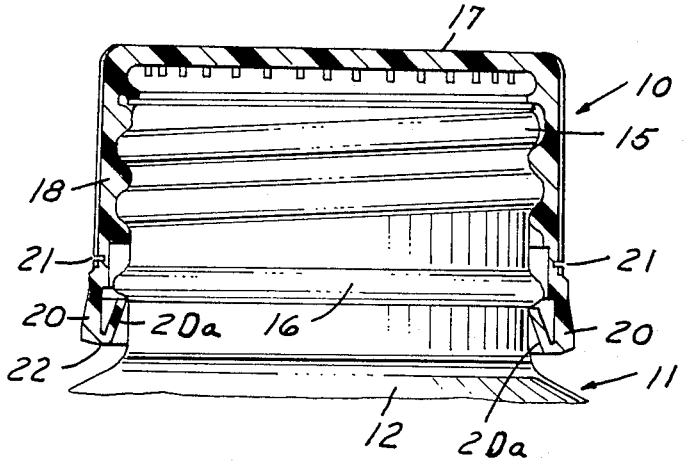
FIG. 2 is a sectional view taken along the line 2—2 in FIG. 1.
Figure 3:
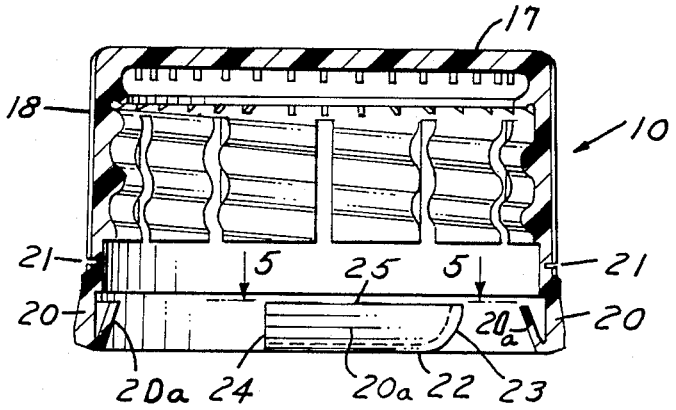
FIG. 3 is a sectional view of the closure before it is applied to the container.
Figure 4:
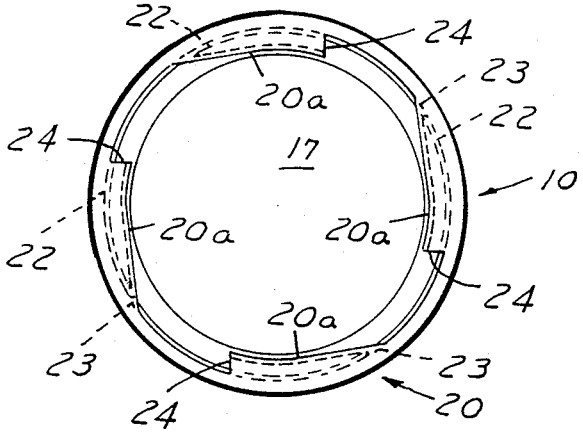
FIG. 4 is a bottom plan view of the closure.
Figure 5:
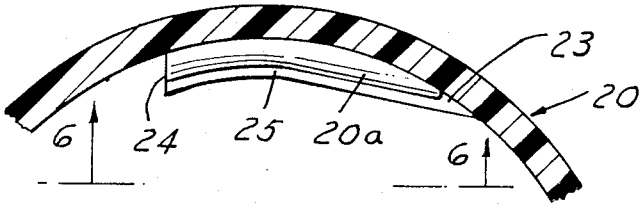
FIG. 5 is a fragmentary sectional view on an enlarged scale taken along the line 5—5 in FIG. 3.
Figure 6:
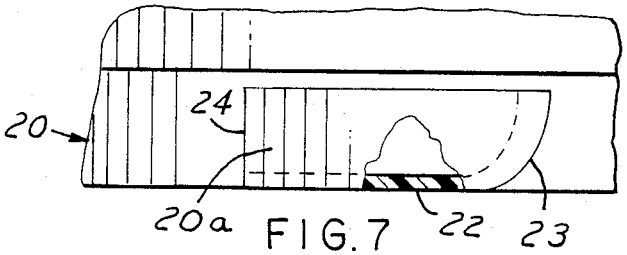
FIG. 6 is a fragmentary part sectional view taken along the line 6—6 in FIG. 5.
Figure 7:
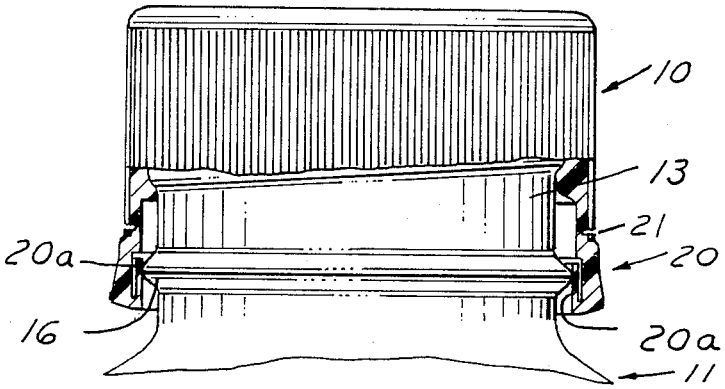
FIG. 7 is a fragmentary part sectional view showing the closure as it is being applied to the container.
Figure 8:
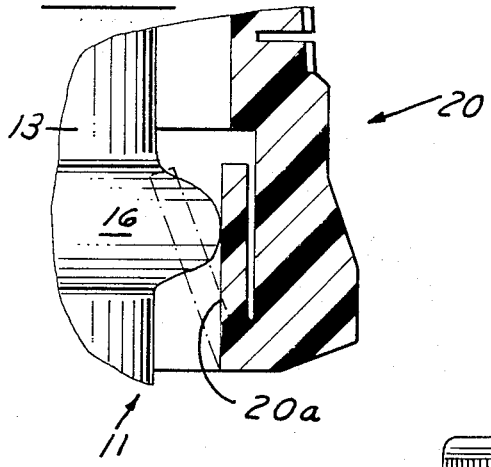
FIG. 8 is a fragmentary sectional view on an enlarged scale of a portion of the closure shown in FIG. 7.

Referring to FIGS. 1–7, the tamper indicating package embodying the invention comprises a closure 10 which is applied to a container 11. The container includes a body portion 12, a finish or neck 13 having external threads 15 and a retaining bead 16 beneath the threads.

The closure 10 is made of plastic such as polypropylene and comprises a base wall 17, a peripheral wall or skirt 18 and a tamper indicating band 20 connected to the lower edge of the skirt 18 along a weakened line 21 such as formed by scoring or circumferentially spaced bridges, herein shown as a scoreline.

The tamper indicating band 20 includes at least one flange or segment **20*a* which is hinged to the inner surface of the band along a first circumferentially extending hinge 22 adjacent the free edge of the band 20 and at one end along a second hinge 23 which extends at an angle to the first hinge 22, herein shown as a curved hinge 23 extending from the hinge 22 axially of the closure. The other circumferential edge 24 of the flange 20*a* is free as is the top circumferential edge 25**.

The number of segments **20*a*** may be varied between as few as one and as many as is geometrically possible to fit into a closure of a given diameter.

As shown in the drawings, the second hinge 23 forms the leading edge of each segment **20*a* and free edge 24 extends rearwardly as the closure is applied to facilitate the application of the closure and minimize the force for application. As the closure is applied, the flanges 20*a* flex radially outwardly past the threads 15 and the retaining bead 16 until they pass the retaining bead 16 so that the free edges 24, 25** flex radially inwardly beneath the bead.

The closure can be made by injection molding or compression molding in molds that have radially spaced mold portions which extend circumferentially and are spaced from other portions to define the segments **20*a***.

After molding, rotation of the relative parts will permit the closure to be stripped from the mold portions defining the segments by a relative rotation after which the closure may be ejected from the central core portion which forms the remaining portions of the closure including the base wall, peripheral skirt and threads.

Figure 10:
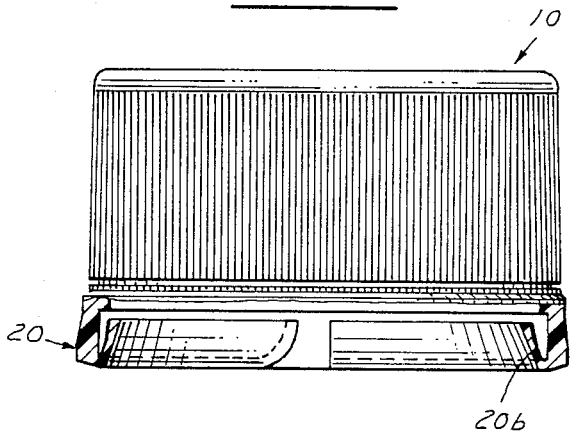
FIG. 10 is a part sectional view taken along the line 10—10 in FIG. 9.
Figure 9:
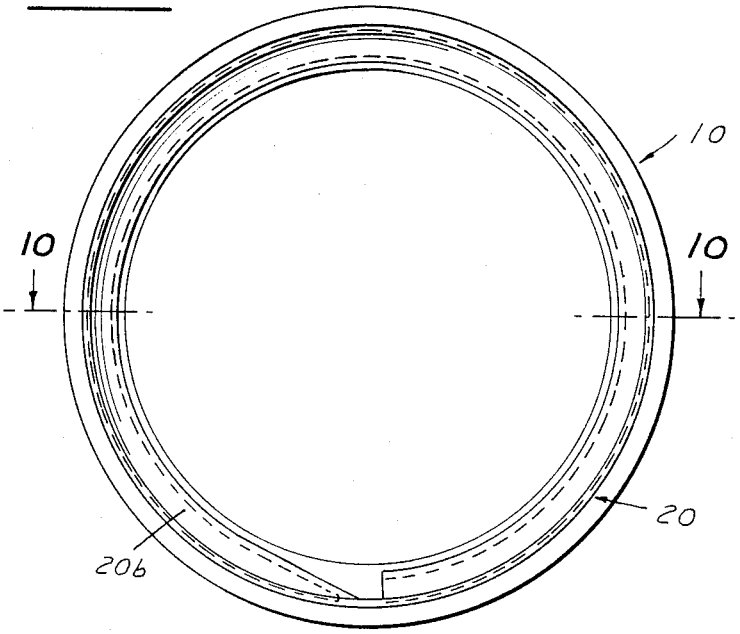
FIG. 9 is a bottom plan view of a modified form of closure.

In the modified closure set forth in FIGS. 9 and 10, a single segment 20*b* is provided on the band 20 and extends substantially along the entire band. In this form, the thickness of the segment increases in an axial direction from the first hinge toward the free edge.

It can thus be seen that there has been provided a tamper indicating package with an improved arrangement for interengaging the closure with the container so that when the closure is removed the tamper indicating band remains on the container; wherein the closure can be readily applied to the container; wherein the tamper indicating package effectively minimizes tampering; wherein there is no need for inverting of any portion of the closure after molding; wherein the closure can be designed to provide different degrees of retention; and which can be readily manufactured.

I claim:

1. A tamper indicating package comprising a container having a finish with external threads thereon and retaining means thereon, a plastic closure comprising a base wall and a peripheral skirt having internal threads for engaging threads on the container, said closure having a tamper indicating band connected to the skirt along a weakened line, said band having at least one flange extending upwardly and inwardly for engagement with the retaining means on the container, said flange being hinged to the band along a first integral hinge extending circumferentially of the band and along a second integral hinge at an angle to- the first hinge at one end, the other end of said flange circumferentially spaced from said one end being free such that when the closure is applied to the container the flange flexes over the retaining means on the container until the free edge of the flange extends beneath the retaining means on the container and when the closure is rotated to remove the closure, the flange prevents the band from being removed and causes severing of the band along the weakened line.

2. The tamper indicating package set forth in claim 1 wherein said second hinge extends from said first hinge and substantially axially of the closure.

3. The tamper indicating package set forth in claim 2 wherein said flange is generally rectangular and said flange tapers circumferentially from the second hinge to the free edge of the other end thereof.

4. The tamper indicating package set forth in any of claims 1–3 wherein a plurality of flanges are provided.

5. The tamper indicating package set forth in any of claims 1–3 wherein the thickness of the flange increases axially from the first hinge.

6. A tamper indicating closure for use with a container having a finish with external threads thereon and retaining means thereon comprising:

a plastic closure having a base wall and a peripheral skirt, said closure having a tamper indicating band connected to the skirt along a weakened line, said band having at least one flange extending upwardly and inwardly for engagement with means on a container, said flange being hinged to the band along a first integral hinge extending circumferentially of the band and along a second integral hinge at an angle to the first hinge at one end, the other end of said flange circumferentially spaced from said one end being free such that when the closure is applied to the container the flange flexes over the retaining means on a container until the free edge of the flange extends beneath the retaining means on the container and when the closure is rotated to remove the closure, the flange prevents the band from being removed and causes severing of the band along the weakened line.

7. The tamper indicating closure set forth in claim 6 wherein said second hinge extends from said first hinge and substantially axially of the closure.

8. The tamper indicating closure set forth in claim 7 wherein said flange is generally rectangular and said flange tapers circumferentially from the second hinge to the free edge of the other end thereof.

9. The tamper indicating closure set forth in any of claims 6–8 wherein a plurality of flanges are provided.

10. The tamper indicating package set forth in any of claims 6–8 wherein the thickness of the flange increases axially from the first hinge.

* * * * *